US005372387A

United States Patent [19]

Wajda

[11] Patent Number: 5,372,387

[45] Date of Patent: Dec. 13, 1994

[54] SECURITY DEVICE FOR DOCUMENT PROTECTION

[76] Inventor: Tadeusz Wajda, 2097 Saw Mill River Rd., Yorktown Heights, N.Y. 10598

[21] Appl. No.: 990,725

[22] Filed: Dec. 15, 1992

[51] Int. Cl.[5] ..... B42D 15/00

[52] U.S. Cl. ..... 283/87; 283/89; 283/91; 283/95; 283/117; 283/902

[58] Field of Search ..... 283/87, 89, 117, 74, 283/902, 91, 95

[56] References Cited

U.S. PATENT DOCUMENTS

| | | | |
|---|---|---|---|
| 3,451,143 | 6/1969 | Thomas et al. | 35/9 |
| 3,594,933 | 7/1971 | Cooper | 283/89 |
| 3,632,364 | 1/1972 | Thomas et al. | 35/9 |
| 3,640,009 | 2/1972 | Komiyama | 283/89 X |
| 4,038,761 | 8/1977 | Thomas | 35/9 G |
| 4,189,353 | 2/1980 | Harriman | 283/87 X |
| 4,891,250 | 1/1990 | Weibe et al. | 428/7 |
| 5,193,854 | 3/1993 | Borowski, Jr. et al. | 283/902 X |

OTHER PUBLICATIONS

Xerox Disclosure Journal vol. 4 No. 2 Mar./Apr. 1979; p. 273; Prevention of Copying Copy-Righted Documents, Lahr, R. J. & Thornburg, D. D.

*Primary Examiner*—Paul A. Bell

*Attorney, Agent, or Firm*—Michael J. Desha

[57] ABSTRACT

The document or substrate containing the information to be protected is covered with a liquid crystal or other such material capable of being made transparent using a process such as heating it to a higher temperature than ambient room temperature. In this manner the information on the substrate is normally invisible and thus not accessible to individuals without special equipment. For copying, the coated substrate is then placed on a copier machine in which the transparent glass plate of the copier is heated, for instance by electrical resistance heating, to a temperature matching the temperature-transparency window of the coating on the document. The information on the substrate may also be made visible for viewing by covering the coating with a transparent plate heated to the proper temperature. A second coating of different color but substantially the same temperature transparency may be selectively applied to the first coating to provide normally visible information. The actual temperature at which the coating becomes transparent may be varied for further security. For even greater security, regions of the coating may have varying temperature transparency so that they may not be visible simultaneously at a single temperature.

8 Claims, 1 Drawing Sheet

SECURITY DEVICE FOR DOCUMENT PROTECTION

FIELD OF THE INVENTION

The invention relates to security devices for protecting information such as photographs, documents, books, or the like from viewing or copying.

BACKGROUND OF THE INVENTION

There are many instances when there is a need to maintain information in a confidential manner safe from inadvertent or intentional viewing and yet have it available for almost immediate access when required.

There are a number of so-called disappearing inks and the like which have been formulated to keep writings a secret, but these do not necessarily protect the document and will not serve to protect writings or other subject matter generated by ordinary writing and printing means. U.S. Pat. Nos. 3,451,143 and 3,632,364 describe a variation on instructional sheets formed by spirit duplication to conceal information which is later made visible by a color change.

U.S. Pat. No. 4,038,761 describes use of the color-change capability of liquid crystals to show a correct answer in selected portions of the sheet whenever the temperature of a liquid crystal segment reaches its transition temperature and changes color or becomes transparent to show information keyed to the selected portions of the sheet.

It is also known to use the liquid crystal sheets for the purpose of providing temperature scales by exposing temperature markings or the like under a sheet of liquid crystal having temperature transition states changing in correspondence with the portion of the underlying scale exposed as the temperature changes. U.S. Pat. No. 4,891,250 teaches the use of a layer of nematic crystal material to provide color changes with temperature to monitor the operating temperature of electrical components.

SUMMARY OF THE INVENTION

It is an object of the invention to provide a security means for protecting information on a substrate which may nevertheless be made accessible using appropriate apparatus and which reverts to its previous state after viewing or copying.

The substrate containing the information to be protected is covered with a liquid crystal or other such material capable of being made transparent using a process such as heating it to a higher temperature than ambient room temperature. In this manner the information on the substrate is normally invisible and thus not accessible to individuals without special equipment. For copying, the coated substrate is then placed on a copier machine in which the transparent glass plate of the copier is heated, for instance by electrical resistance heating, to a temperature matching the temperature-transparency window of the coating on the document. The information on the substrate may also be made visible by covering the coating with a transparent plate heated to the proper temperature. The actual temperature at which the coating becomes transparent may be varied for further security. For even greater security, regions of the coating may have varying temperature transparency so that they may not be visible simultaneously at a single temperature.

Thus the object of the invention is attained by providing in combination, a substrate having information thereon, said substrate having a coating thereon, said coating comprising a normally opaque material which becomes transparent at a selected transition temperature above room temperature, and viewing means comprising a transparent plate and means for heating said transparent plate to a temperature corresponding to the transition temperature of the coating on the substrate whereby the coating is rendered transparent when placed in juxtaposition to the heated plate. In another embodiment, the coating itself may comprise information, such as for example a picture, where the normally opaque materials of which it is comprised include areas or lines of different shades of grey as required at normal temperatures, but which have the same or nearly the same transition temperature so as to reveal the underlying information on the substrate at the temperature transparency window.

The coating may have regions or windows of different temperature-transparent materials in order to further protect some information or some of the information on the sheet may be visible at ambient room temperature. It will also be understood that it is contemplated that the coating may be provided with varying temperature transitions which must be matched by the temperature gradients over the transparent plate in order to render the information on the substrate completely visible at one time.

BRIEF DESCRIPTION OF THE DRAWINGS

The present invention will become apparent from the following detailed description taken in conjunction with the accompanying drawings in which.

BRIEF DESCRIPTION OF THE PREFERRED EMBODIMENTS

Figure 1:
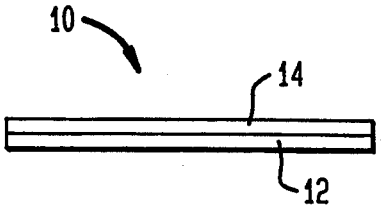
FIG. 1 is a side view of a sheet having a coating in accordance with the invention.

Referring to FIG. 1, there is depicted at 10 a side view of a sheet in accordance with the invention which comprises a substrate 12 such as a document, a page of a book, or a book or document cover or the like having a coating 14 thereon. The coating 14 comprises a selected material chosen so as to be opaque at normal room ambient temperatures but which will become transparent at a selected higher temperature. By way of example, the coating 14 may be selected from among the materials referred to as liquid crystals or specific mixtures thereof. Such materials are well known in the art and may be combined to provide transition temperature windows of transparency (temperature-transparency) in the neighborhood of two-degrees C. Other materials of similar nature are also known and may be chosen as desired for use in accordance with the invention.

Figure 2:
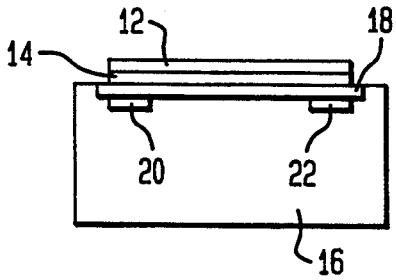
FIG. 2 is a block diagram of a copier having the sheet of FIG. 1 thereon.

FIG. 2 shows in block diagram a copier machine 16 which may be of conventional design except insofar as the transparent plate 18 on which the substrate to be copied normally rests. In accordance with the invention, the plate 18 is heated, conveniently by resistance heaters indicated at 20 and 22 such that the temperature of the plate 18 corresponds to the temperature-transparency window of the coating on the substrate. It will be appreciated that when a copy is made of the sheet 10 with its coating 14 heated to the temperature where it is transparent by the plate 18, the information on the substrate 12 will be visible. When the sheet 10 is removed and the coating 14 cools, the information on the substrate 12 will again be invisible.

It will be understood that the heated transparent plate 18 is not necessarily associated with a copying device. A device for viewing the document may comprise a separate plate heated to the appropriate temperature for direct viewing of the information on the substrate through the heated transparent plate.

Figure 3:
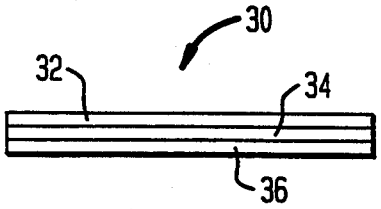
FIG. 3 is a side view of a sheet having an additional protective coating.

It will also be appreciated that there may be areas of a substrate which may be uncoated or coated with a material which remains transparent at normal ambient temperatures so that, for example, the document may be identified. It will also be understood that as seen in FIG. 3, a sheet 30 may have a protective coating 32 over the temperature-sensitive coating shown in FIG. 3 as 34 on a substrate 36.

Figure 4:
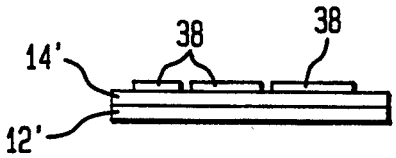
FIG. 4 is a side view of a sheet having an additional coating of different color material on selected areas to create normally visible information; and, FIG. 5 is a top view of another embodiment of a coated sheet and a corresponding transparent plate having heating elements thereon.

Another embodiment in accordance with the invention is shown in FIG. 4. As seen in this Figure, sheet 12' has a first coating 14' of a selected temperature transparency which may be for example a light color or white to form a background for selected areas of darker material, of the same or nearly the same temperature transparency, indicated at 38 applied so as to form a writing or picture, for example. It will be appreciated that since the two materials are of the same or nearly the same temperature transparency, when it is viewed or copied as previously described, the information provided by layers 14' and 38 will disappear as the layers become transparent when they reach the transition temperature and the underlying information on the substrate will become visible.

Returning to the FIG. 1, it will also be understood that the coating 14 shown in FIG. 1 may be selectively applied to the substrate 12 in order to cover selected portions of the information on the substrate. For example, where the underlying information on the substrate is a picture, the coating 14 may be used to change a portion of the picture from one form to another depending on the temperature.

Figure 5:
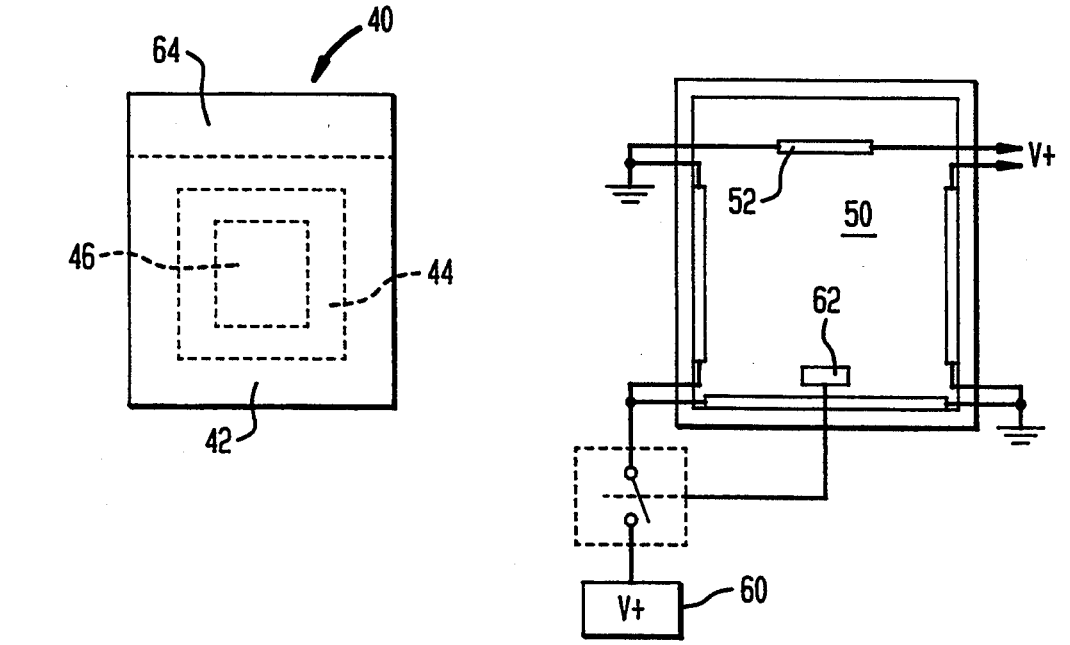

In order to increase security the selected coating material for one user and the corresponding plate temperature may differ from those provided to another user. FIG. 5 shows a top view of a sheet 40 having a coating with regions 42, 44, and 46 of varying temperature-transparency to provide even greater security. In this embodiment, for viewing all of the information at once, the transparent plate 50 must be heated in a manner to correspond to the temperature sensitivity of the coating suitably by a selected configuration of resistance heaters as shown, for example, at 52–58, connected to a source of electrical power at 60. If required there may be a temperature measuring device 62 connected to control the resistance heaters. It will also be understood that other methods of heating the plate may be used such as infrared or other radiant heating devices, if desired.

As brought out previously, a region such as region 64 may be coated with a clear coating or may be transparent at ambient room temperature in order to allow identification.

What is claimed is:

1. In combination, a substrate having information thereon, said substrate having a coating thereon covering the information, said coating comprising a normally opaque material which becomes transparent at a selected transition temperature above room temperature, and means for rendering the information visible comprising a transparent plate and means for heating said transparent plate to a temperature corresponding to the transition temperature of the coating on the substrate whereby the coating is rendered transparent when placed in juxtaposition to the heated plate.

2. The combination of claim 1 wherein the coating has regions of different temperature transition materials in order to prevent some information from being visible with a selected heated transparent plate.

3. The combination of claim 1 wherein the coating is selectively applied so that some of the information on the substrate is visible at ambient room temperature.

4. The combination of claim 1 wherein the coating is provided with varying temperature transition regions and the transparent plate has matching temperature gradients in order to render the information on the substrate completely visible at one time.

5. The combination of claim 1 further comprising a protective coating over the coating on the substrate.

6. The combination of claim 1 wherein the coating on the substrate is a coating of a first color and further comprising a selectively applied coating of a second coating of a different second color material having a substantially similar temperature transition.

7. The combination of claim 1 wherein the transparent plate is the glass plate of a copier device.

8. A sheet comprising a substrate having information thereon, a first coating comprising a normally opaque material which becomes transparent at a selected transition temperature above room temperature, said first coating being of a first color, and a second coating selectively applied to said first coating for providing information thereon, said second coating comprising a normally opaque material of a second color different from the first color and having a transition temperature substantially the same as that of the first coating.

* * * * *